US011322826B2

(12) United States Patent
Huang et al.

(10) Patent No.: US 11,322,826 B2
(45) Date of Patent: May 3, 2022

(54) ANTENNA STRUCTURE

(71) Applicant: Wistron NeWeb Corp., Hsinchu (TW)

(72) Inventors: Chin-Lien Huang, Hsinchu (TW); Kuo-Jen Lai, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 171 days.

(21) Appl. No.: 16/867,914

(22) Filed: May 6, 2020

(65) Prior Publication Data

US 2021/0143529 A1 May 13, 2021

(30) Foreign Application Priority Data

Nov. 11, 2019 (TW) ..... 108140790

(51) Int. Cl.

| | |
|---|---|
| ***H01Q 1/24*** | (2006.01) |
| ***H01Q 9/42*** | (2006.01) |
| ***H01Q 5/35*** | (2015.01) |
| ***H01Q 1/48*** | (2006.01) |
| ***H01Q 13/10*** | (2006.01) |

(52) U.S. Cl.

CPC ..... *H01Q 1/243* (2013.01); *H01Q 1/48* (2013.01); *H01Q 5/35* (2015.01); *H01Q 9/42* (2013.01); *H01Q 13/10* (2013.01)

(58) Field of Classification Search

CPC H01Q 13/10; H01Q 9/42; H01Q 1/48; H01Q 5/35; H01Q 1/243

See application file for complete search history.

(56) References Cited

U.S. PATENT DOCUMENTS

| | | | | |
|---|---|---|---|---|
| 9,356,356 | B2 | 5/2016 | Chang et al. | |
| 2018/0301789 | A1 | 10/2018 | Lee et al. | |
| 2019/0260126 | A1* | 8/2019 | Ayala Vazquez | H01Q 1/243 |

FOREIGN PATENT DOCUMENTS

| | | | |
|---|---|---|---|
| TW | I539673 | B | 6/2016 |
| TW | M539159 | U | 4/2017 |
| TW | I635653 | B | 9/2018 |

* cited by examiner

*Primary Examiner* — Graham P Smith

(74) *Attorney, Agent, or Firm* — McClure, Qualey & Rodack, LLP

(57) ABSTRACT

An antenna structure includes a ground element, a metal mechanism element, a feeding element, a first connection element, a second connection element, and a shorting element. The metal mechanism element has a slot. The slot has a first edge and a second edge which are opposite to each other. The feeding element extends across the slot. A signal source is coupled through the feeding element to a feeding point on the first edge. The first connection element is coupled between a first connection point on the first edge and a second connection point on the second edge. The second connection element is coupled between a third connection point on the first edge and a fourth connection point on the second edge. A first grounding point on the second edge is coupled through the shorting element to the ground element.

16 Claims, 5 Drawing Sheets

ANTENNA STRUCTURE

CROSS REFERENCE TO RELATED APPLICATIONS

This application claims priority of Taiwan Patent Application No. 108140790 filed on Nov. 11, 2019, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly added metal elements tend to negatively affect the antennas used for wireless communication in mobile devices, thereby degrading the overall communication quality of the mobile devices. As a result, there is a need to propose a novel mobile device with a novel antenna structure, so as to overcome the problems of the prior art.

BRIEF SUMMARY OF THE INVENTION

In an exemplary embodiment, the disclosure is directed to an antenna structure that includes a ground element, a metal mechanism element, a feeding element, a first connection element, a second connection element, and a shorting element. The metal mechanism element has a slot. The slot has a first edge and a second edge which are opposite to each other. The feeding element extends across the slot. A signal source is coupled through the feeding element to a feeding point on the first edge. The first connection element extends across the slot. The first connection element is coupled between a first connection point on the first edge and a second connection point on the second edge. The second connection element extends across the slot. The second connection element is coupled between a third connection point on the first edge and a fourth connection point on the second edge. A first grounding point on the second edge is coupled through the shorting element to the ground element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
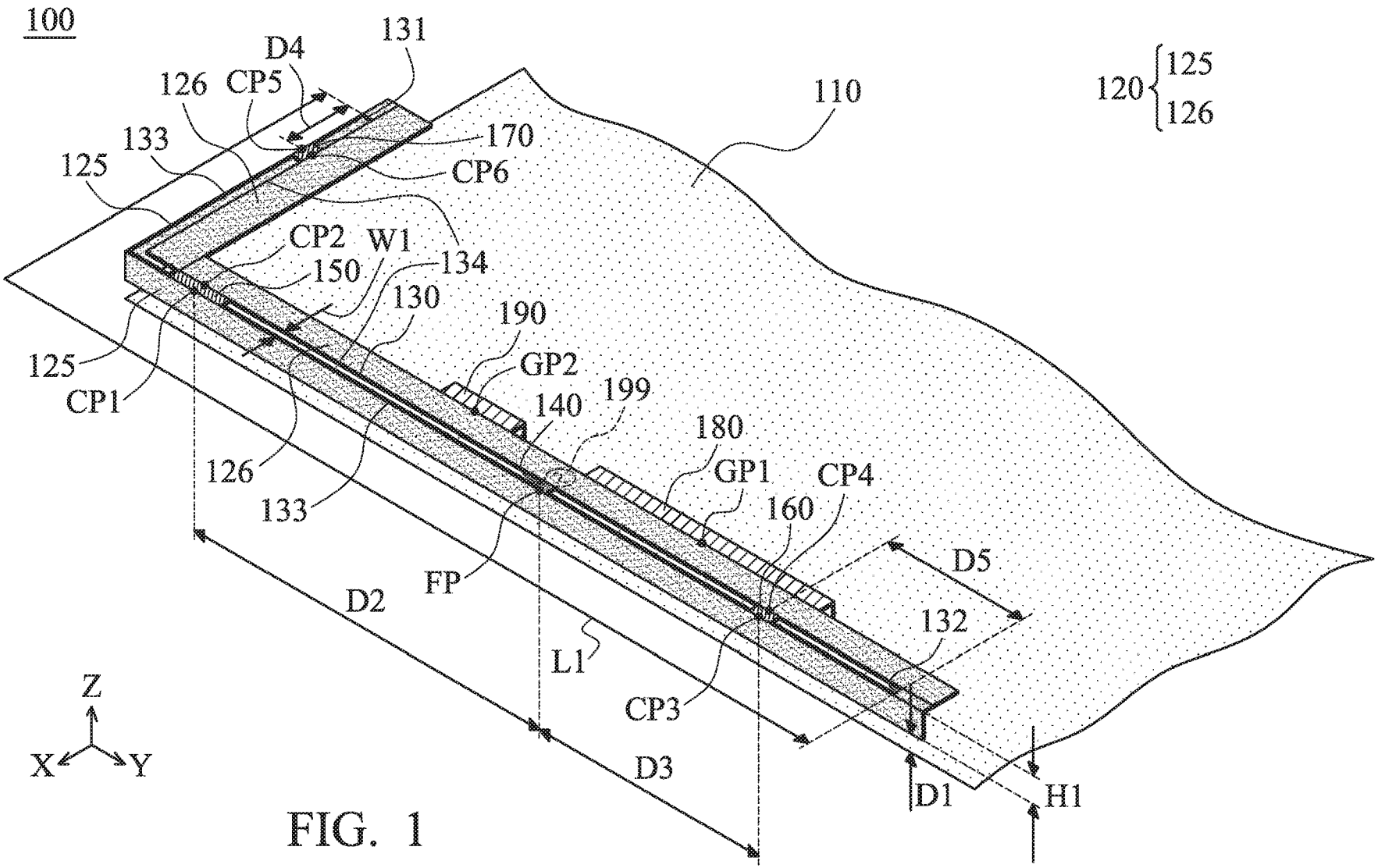
FIG. 1 is a perspective view of an antenna structure according to an embodiment of the invention.

FIG. 1 is a perspective view of an antenna structure 100 according to an embodiment of the invention. The antenna structure 100 may be applied to a mobile device, such as a smartphone, a tablet computer, or a notebook computer. In the embodiment of FIG. 1, the antenna structure 100 includes a ground element 110, a metal mechanism element 120, a feeding element 140, a first connection element 150, a second connection element 160, a third connection element 170, a shorting element 180, and a tuning element 190. The ground element 110, the feeding element 140, the first connection element 150, the second connection element 160, the third connection element 170, and the shorting element 180 may all be made of metal materials, such as copper, silver, aluminum, iron, or their alloys.

The ground element 110 may be a system ground plane of the antenna structure 100, and it is configured to provide a ground voltage VSS (e.g., 0V). In some embodiments, the ground element 110 is a ground metal plane disposed on a dielectric substrate, such as an FR4 (Flame Retardant 4) substrate or a PCB (Printed Circuit Board).

The metal mechanism element 120 may be a 3D (Three Dimensional) structure. In some embodiments, the metal mechanism element 120 includes a sidewall portion 125 and a top planar portion 126 which are substantially perpendicular to each other. For example, the sidewall portion 125 may be distributed over the XZ-plane and the YZ-plane, and the top planar portion 126 may be distributed over the XY-plane. The sidewall portion 125 of the metal mechanism element 120 may be an appearance element of a mobile device. The term "appearance element" refers to a portion of the mobile device which a user's eyes can see directly when the user looks at the mobile device including the antenna structure 100. Furthermore, the metal mechanism element 120 has a slot 130 formed between the sidewall portion 125 and the top planar portion 126. The slot 130 may substantially have an L-shape. For example, the slot 130 may be a closed slot with a first closed end 131 and a second closed end 132. Specifically, the slot 130 has a first edge 133 and a second edge 134 which are opposite to each other, and they are both positioned between the first closed end 131 and the second closed end 132. However, the invention is not limited thereto. In alternative embodiments, adjustments are made and the whole metal mechanism element 120 is a planar structure, such that the sidewall portion 125, the top planar portion 126 and the slot 130 are all distributed on the same plane.

The feeding element 140 may substantially have a straight-line shape or a rectangular shape. The feeding element 140 extends across the slot 130 of the metal mechanism element 120. A signal source 199 is coupled through the feeding element 140 to a feeding point FP on the first edge 133. For example, the signal source 199 may be an RF (Radio Frequency) module for exciting the antenna structure 100.

The first connection element 150 may substantially have a straight-line shape or a rectangular shape. The first connection element 150 extends across the slot 130 of the metal mechanism element 120. Specifically, the first connection element 150 is coupled between a first connection point CP1 on the first edge 133 and a second connection point CP2 on the second edge 134.

The second connection element 160 may substantially have a straight-line shape or a rectangular shape. The second connection element 160 extends across the slot 130 of the metal mechanism element 120. Specifically, the second connection element 160 is coupled between a third connection point CP3 on the first edge 133 and a fourth connection point CP4 on the second edge 134. The third connection point CP3 and the fourth connection point CP4 are different from the first connection point CP1 and the second connection point CP2. In some embodiments, the feeding element 140 is positioned between the first connection element 150 and the second connection element 160.

The third connection element 170 may substantially have a straight-line shape or a rectangular shape. The third connection element 170 extends across the slot 130 of the metal mechanism element 120. Specifically, the third connection element 170 is coupled between a fifth connection point CP5 on the first edge 133 and a sixth connection point CP6 on the second edge 134. The fifth connection point CP5 and the sixth connection point CP6 are different from the first connection point CP1, the second connection point CP2, the third connection point CP3, and the fourth connection point CP4. It should be noted that the third connection element 170 is an optional component, which is removable in other embodiments.

The shorting element 180 may be a bending structure or a planar structure. A grounding point GP1 on the second edge 134 is coupled through the shorting element 180 to the ground element 110.

Figure 2:
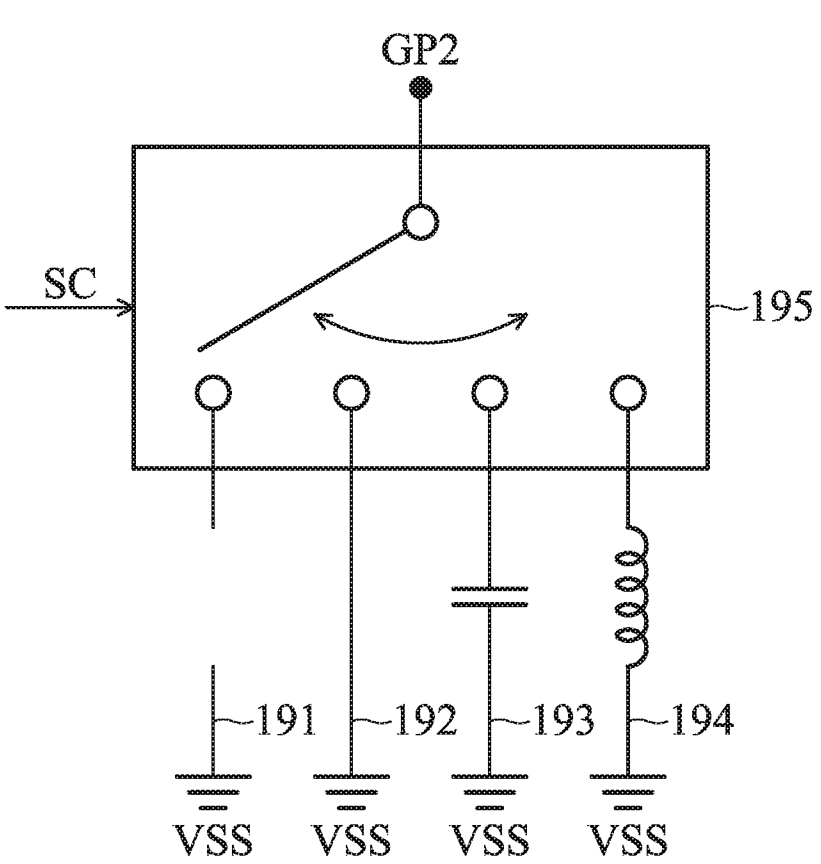
FIG. 2 is an equivalent circuit diagram of an tuning element according to an embodiment of the invention.

The tuning element 190 may be a bending structure or a planar structure. In some embodiments, the feeding element 140 is positioned between the shorting element 180 and the tuning element 190. FIG. 2 is an equivalent circuit diagram of the tuning element 190 according to an embodiment of the invention. The tuning element 190 includes a first impedance path 191, a second impedance path 192, a third impedance path 193, a fourth impedance path 194, and a switch circuit 195. The first impedance path 191, the second impedance path 192, the third impedance path 193, and the fourth impedance path 194 have different impedance values, and they are respectively coupled to the ground voltage VSS of the ground element 110. A terminal of the switch circuit 195 is coupled to a second grounding point GP2 on the second edge 134, and another terminal of the switch circuit 195 is switched between the first impedance path 191, the second impedance path 192, the third impedance path 193, and the fourth impedance path 194. The second grounding point GP2 may be different from the first grounding point GP1. Specifically, the switch circuit 195 selects one of the first impedance path 191, the second impedance path 192, the third impedance path 193, and the fourth impedance path 194 as a target path according to a control signal SC, such that the second grounding point GP2 is coupled through the target path to the ground element 110. For example, the control signal SC may be generated by a processor according to a user's input. In some embodiments, the first impedance path 191 is an open-circuited path, the second impedance path 192 is a short-circuited path, the third impedance path 193 is a capacitive path, and the fourth impedance path 194 is an inductive path, but they are not limited thereto. In should be noted that the tuning element 190 is an optional component, which is removable in other embodiments.

Figure 3:
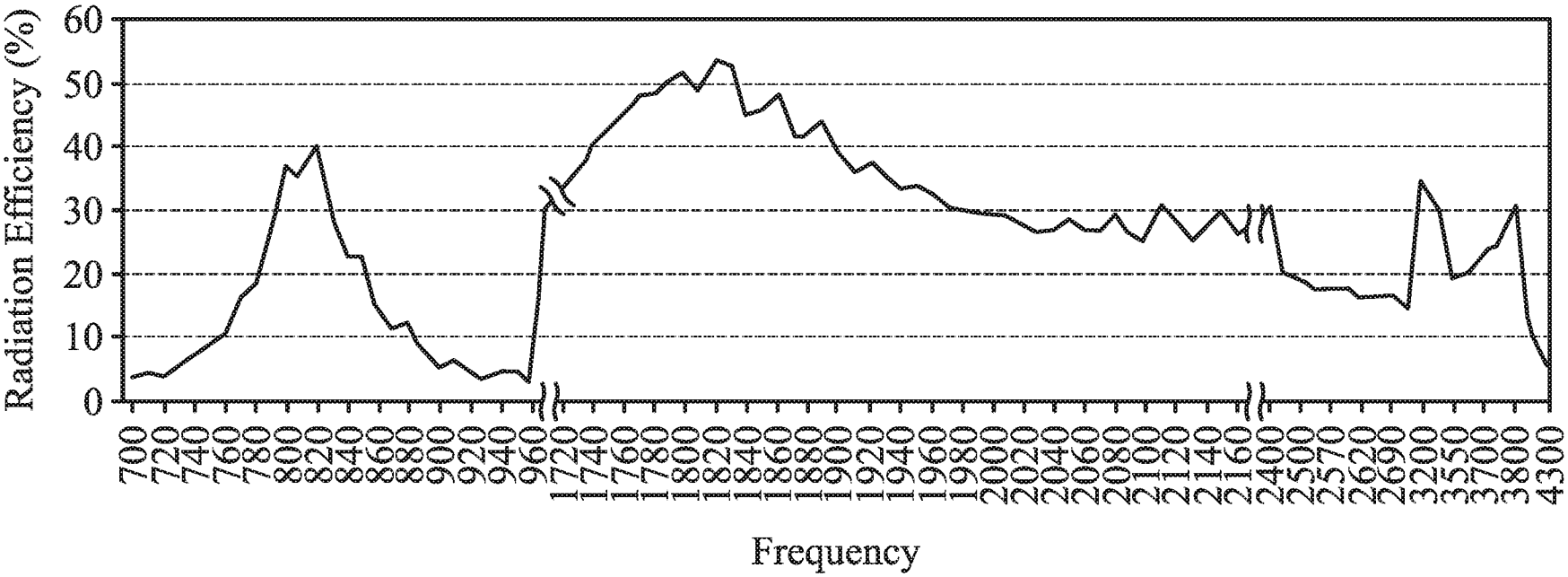
FIG. 3 is a diagram of radiation efficiency of an antenna structure according to an embodiment of the invention.

FIG. 3 is a diagram of radiation efficiency of the antenna structure 100 according to an embodiment of the invention. According to the measurement of FIG. 3, the antenna structure 100 can cover a first frequency band, a second frequency band, and a third frequency band. The first frequency band may be from 700 MHz to 960 MHz. The second frequency band may be from 1710 MHz to 2690 MHz. The third frequency band may be from 3300 MHz to 4200 MHz. Therefore, the antenna structure 100 can support at least the wideband operations of LTE (Long Term Evolution) and next-generation 5G system. Furthermore, the radiation efficiency of the antenna structure 100 may reach 40% or higher within the aforementioned frequency bands, and it can meet the requirements of practical application of general mobile communication devices.

In some embodiments, the operation principles of the antenna structure 100 are described as follows. The slot 130 of the metal mechanism element 120 is excited by the feeding element 140, so as to generate the first frequency band, the second frequency band, and the third frequency band. Specifically, the whole slot 130 between the first closed end 131 and the second closed end 132 corresponds to the first frequency band. A portion of the slot 130 between the first connection element 150 and the second connection element 160 corresponds to the second frequency band. Another portion of the slot 130 between the third connection element 170 and the feeding element 140 corresponds to the third frequency band. According to practical measurements, the incorporation of the first connection element 150, the second connection element 160, and the third connection element 170 can help to fine-tune the effective resonant length of the slot 130, thereby increasing the high-frequency operation bandwidth of the antenna structure 100 (especially for the second frequency band and the third frequency band).

Figure 4:
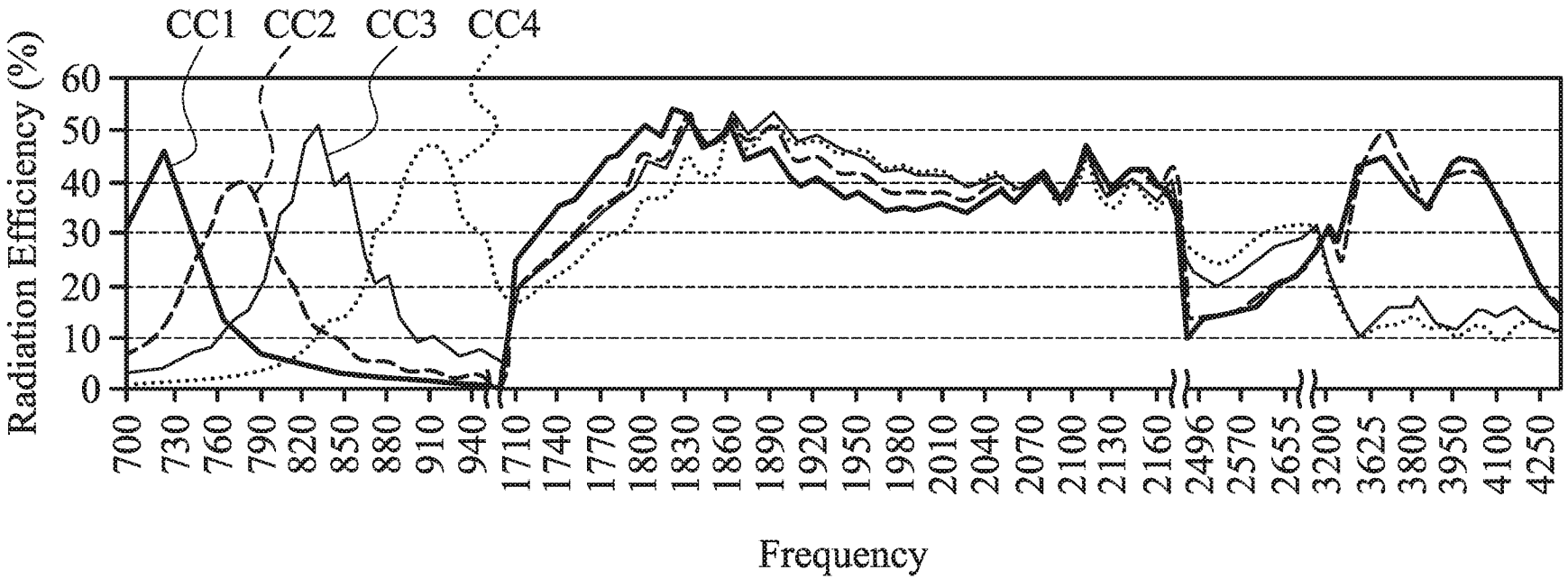
FIG. 4 is a diagram of radiation efficiency of an antenna structure according to an embodiment of the invention.

FIG. 4 is a diagram of radiation efficiency of the antenna structure 100 according to an embodiment of the invention. As shown in FIG. 4, a first curve CC1 represents the operation characteristic of the antenna structure 100 when the switch circuit 195 selects the first impedance path 191. A second curve CC2 represents the operation characteristic of the antenna structure 100 when the switch circuit 195 selects the second impedance path 192. A third curve CC3 represents the operation characteristic of the antenna structure 100 when the switch circuit 195 selects the third impedance path 193. A fourth curve CC4 represents the operation characteristic of the antenna structure 100 when the switch circuit 195 selects the fourth impedance path 194. In the embodiment of FIG. 4, the first impedance path 191 is an open-circuited path, the second impedance path 192 is a large inductive path (e.g., 9.1 nH), the third impedance path 193 is a median inductive path (e.g., 1 nH), and the fourth impedance path 194 is a small inductive path (e.g., 0.5 nH). According to the measurement of FIG. 4, the antenna structure 100 can effectively increase its low-frequency bandwidth by using the tuning element 190 for switch operations (especially for the first frequency band).

In some embodiments, the element sizes of the antenna structure 100 are described as follows. The length L1 of the slot 130 of the metal mechanism element 120 (i.e., the length from the first closed end 131 to the second closed end 132) may be substantially equal to 0.25 wavelength (λ/4) of the lowest frequency of the first frequency band of the antenna structure 100. The width W1 of the slot 130 of the metal mechanism element 120 (i.e., the distance between the first edge 133 and the second edge 134) may be from 1 mm to 2 mm. The height H1 of the sidewall portion 125 of the metal mechanism element 120 may be from 4 mm to 6 mm, such as about 5 mm. The distance D1 between the ground element 110 and the sidewall portion 125 of the metal mechanism element 120 may be from 1 mm to 2 mm, such as about 1.6 mm. The distance between the first connection point CP1 and the feeding point FP is defined as a first distance D2. The distance between the third connection point CP3 and the feeding point FP is defined as a second distance D3. The first distance D2 may be from 1 to 2 times the second distance D3, such as about 1.8 times. The distance between the sixth connection point CP6 and the first closed end 131 is defined as a third distance D4. The distance between the fourth connection point CP4 and the second closed end 132 is defined as a fourth distance D5. The fourth distance D5 may be from 2 to 3 times the third distance D4, such as about 2.2 times. In the tuning element 190, the capacitance of the third impedance path 193 may be from 0.5 pF to 10 pF, and the inductance of the fourth impedance path 194 may be from 1 nH to 36 nH. The above ranges of element parameters are calculated and obtained according to many experiment results, and they help to optimize the operation bandwidth and impedance matching of the antenna structure 100.

In some embodiments, the ground element 110 is disposed on a keyboard frame. The term "keyboard frame" refers to the so-called "C-component" in the field of notebook computers. When a base housing is disposed opposite to the keyboard frame, the base housing is made of a metal material but has a nonconductive window, such that the whole vertical projection of the slot 130 of the metal mechanism element 120 is inside the antenna window. The term "base housing" refers to the so-called "D-component" in the field of notebook computers. The electromagnetic waves of the antenna structure 100 can be transmitted through the antenna window of the base housing. It should be noted that according to practical measurements, the radiation performance of the antenna structure 100 is maintained unchanged within the desired frequency band, regardless of whether the base housing is incorporated or not.

Figure 5:
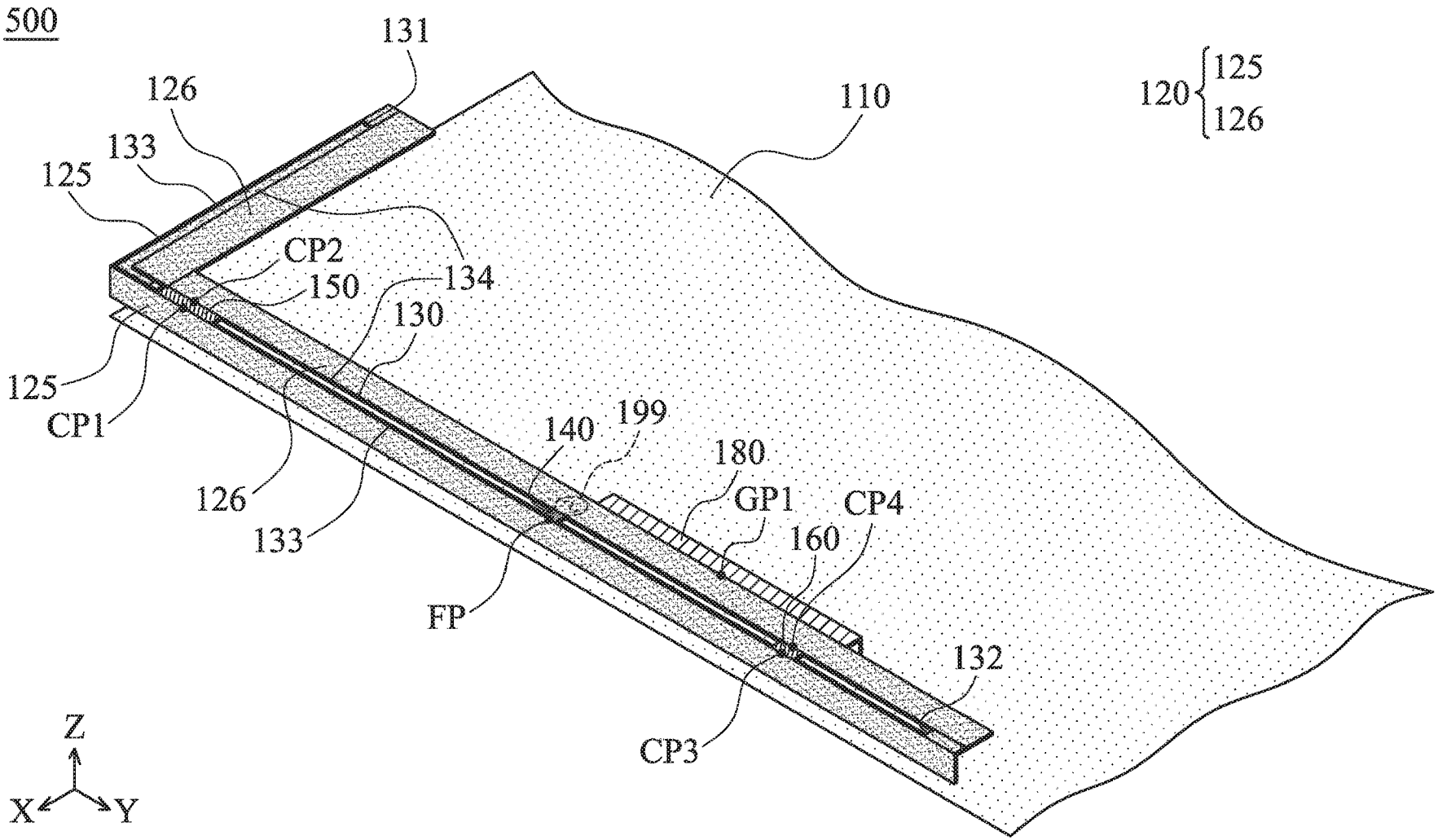
FIG. 5 is a perspective view of an antenna structure according to another embodiment of the invention.

FIG. 5 is a perspective view of an antenna structure 500 according to another embodiment of the invention. FIG. 5 is similar to FIG. 1. In the embodiment of FIG. 5, the antenna structure 500 does not include the third connection element 170 and the tuning element 190 as described above. However, after the element sizes are appropriately adjusted, the antenna structure 500 can still cover the wideband operations of LTE and 5G as mentioned above. Other features of the antenna structure 500 of FIG. 5 are similar to those of the antenna structure 100 of FIG. 1. Therefore, the two embodiments can achieve similar levels of performance.

The invention proposes a novel antenna structure for covering wideband operations. When the antenna structure is applied to a mobile device including a metal mechanism element, the metal mechanism element does not negatively affect the communication quality of the mobile device because the metal mechanism element is considered as an extension portion of the antenna structure. In comparison to the conventional PIFA (Planar Inverted F Antenna) having a total height from 8 mm to 10 mm, the invention proposes an antenna structure having a total height reduced by about 50%. In conclusion, the invention has at least the advantages of small size, wide bandwidth, and beautiful device appearance, and therefore it is suitable for application in a variety of mobile communication devices with narrow borders.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-5. The invention may merely include any one or more features of any one or more embodiments of FIGS. 1-5. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a ground element;

a metal mechanism element, having a slot, wherein the slot has a first edge and a second edge opposite to each other;

a feeding element, extending across the slot, wherein a signal source is coupled through the feeding element to a feeding point on the first edge;

a first connection element, extending across the slot, wherein the first connection element is coupled between a first connection point on the first edge and a second connection point on the second edge;

a second connection element, extending across the slot, wherein the second connection element is coupled between a third connection point on the first edge and a fourth connection point on the second edge; and a shorting element, wherein a first grounding point on the second edge is coupled through the shorting element to the ground element;

wherein the antenna structure covers a first frequency band, a second frequency band, and a third frequency band, the first frequency band is from 700 MHz to 960 MHz, the second frequency band is from 1710 MHz to 2690 MHz, and the third frequency band is from 3300 MHz to 4200 MHz.

2. The antenna structure as claimed in claim 1, wherein the slot is a closed slot with a first closed end and a second closed end.

3. The antenna structure as claimed in claim 1, wherein the slot substantially has an L-shape.

4. The antenna structure as claimed in claim 1, wherein the metal mechanism element comprises a sidewall portion and a top planar portion which are substantially perpendicular to each other, and the slot is formed between the sidewall portion and the top planar portion.

5. The antenna structure as claimed in claim 1, wherein the feeding element is positioned between the first connection element and the second connection element.

6. The antenna structure as claimed in claim 1, further comprising:

a third connection element, extending across the slot, wherein the third connection element is coupled between a fifth connection point on the first edge and a sixth connection point on the second edge.

7. The antenna structure as claimed in claim 1, further comprising a tuning element which comprises:

a first impedance path;

a second impedance path;

a third impedance path;

a fourth impedance path; and a switch circuit, selecting one of the first impedance path, the second impedance path, the third impedance path, and the fourth impedance path as a target path according to a control signal, such that a second grounding point on the second edge is coupled through the target path to the ground element.

8. The antenna structure as claimed in claim 7, wherein the first impedance path is an open-circuited path.

9. The antenna structure as claimed in claim 7, wherein the second impedance path is a short-circuited path.

10. The antenna structure as claimed in claim 7, wherein the third impedance path is a capacitive path.

11. The antenna structure as claimed in claim 7, wherein the fourth impedance path is an inductive path.

12. The antenna structure as claimed in claim 7, wherein the feeding element is positioned between the shorting element and the tuning element.

13. The antenna structure as claimed in claim 1, wherein a length of the slot is substantially equal to 0.25 wavelength of the lowest frequency of the first frequency band.

14. The antenna structure as claimed in claim 1, wherein a width of the slot is from 1 mm to 2 mm.

15. The antenna structure as claimed in claim 4, wherein a height of the sidewall portion of the metal mechanism element is from 4 mm to 6 mm.

16. The antenna structure as claimed in claim 4, wherein a distance between the ground element and the sidewall portion of the metal mechanism element is from 1 mm to 2 mm.

* * * * *